US010590718B2

(12) United States Patent
Skjaerseth et al.

(10) Patent No.: US 10,590,718 B2
(45) Date of Patent: Mar. 17, 2020

(54) PIPE HANDLING UNIT

(71) Applicant: West Drilling Products AS, Stavanger (NO)

(72) Inventors: Odd B. Skjaerseth, Stavanger (NO); Bjørn Eilertsen, Hundvåg (NO)

(73) Assignee: West Drilling Products AS, Stavanger (NO)

( * ) Notice: Subject to any disclaimer, the term of this patent is extended or adjusted under 35 U.S.C. 154(b) by 225 days.

(21) Appl. No.: 15/903,281

(22) Filed: Feb. 23, 2018

(65) Prior Publication Data

US 2018/0245410 A1 Aug. 30, 2018

(30) Foreign Application Priority Data

Feb. 24, 2017 (NO) ..... 20170271

(51) Int. Cl.
*E21B 19/16* (2006.01)

(52) U.S. Cl.
CPC ..... *E21B 19/164* (2013.01)

(58) Field of Classification Search
CPC ..... E21B 19/16; E21B 19/164; E21B 19/161; E21B 19/162
See application file for complete search history.

(56) References Cited

U.S. PATENT DOCUMENTS

| | | | | |
|---|---|---|---|---|
| 9,404,324 | B2 * | 8/2016 | Hunter | E21B 19/168 |
| 10,119,346 | B2 * | 11/2018 | Randall | E21B 19/16 |
| 2009/0277308 | A1 | 11/2009 | Light et al. | |
| 2017/0370166 | A1 * | 12/2017 | Angelle | E21B 19/164 |

FOREIGN PATENT DOCUMENTS

| | | |
|---|---|---|
| NO | 20130805 | 12/2014 |

OTHER PUBLICATIONS

Norwegian Search Report, Norwegian Patent Application No. 20170271, dated Sep. 26, 2017.
Robotic Pipe Handler, Robotic Drill Systems, dated Jul. 1, 2016, www.rds.no/products/robotic-pipe-handler.

* cited by examiner

*Primary Examiner* — David B. Thomas
(74) *Attorney, Agent, or Firm* — Andrus Intellectual Property Law, LLP

(57) ABSTRACT

A pipe-gripper includes an elongated housing. The pipe gripper further includes a rotor positioned within the elongated housing. The rotor has a periphery and a longitudinal groove extending axially therethrough. The longitudinal groove has an inside face and a groove mouth, The groove mouth has width A. In addition, the pipe gripper includes a toothed rim, the toothed rim positioned on the periphery of the rotor and interrupted by the longitudinal groove. Further, the pipe gripper includes a clamp assembly. The clamp assembly includes at least one clamp and positioned within the rotor. The pipe-gripper also includes a rotor drive, the rotor drive positioned within the elongated housing. In addition, the pipe gripper includes a transmission assembly, the transmission assembly in engagement with the rotor drive at toothed rim engagement points, the distance between toothed rim engagement points being distance B, distance B being larger than distance A.

18 Claims, 13 Drawing Sheets

VI-VI

VII-VII

PIPE HANDLING UNIT

CROSS-REFERENCE TO RELATED APPLICATION

This application claims the benefit of and priority to Norwegian Patent Application No. 20170271, filed Feb. 24, 2017, which is hereby incorporated by reference in entirety.

FIELD

A pipe-gripper for handling a pipe or a pipe stand is disclosed.

BACKGROUND

In the assembling and disassembling of a pipe string, for example a drill string that is used for drilling in hydrocarbon-bearing underground formations, apparatuses and operations associated with moving, rotating and mounting a pipe string, pipe stands and single pipes are used. Conventionally, operations including screwing together pipes, and making up and breaking out pipe joints have been performed by such devices as cooperating backup tongs and power tongs and by cooperating drilling machines or another drilling unit and a backup tongs, as the pipes are moved between the pipe-string center and a pipe rack. Movement of the pipes between the pipe string center and the pipe rack has been performed by such means as one or more manipulators holding and orienting the pipes. Traditional pipe-grippers are unable to provide the required torque to make up/break out pipe joints.

SUMMARY

In certain embodiments of the present disclosure, a pipe-gripper rotates the pipe or the pipe stand around the pipe center axis to screw the pipe or the pipe stand together with a pipe string by supplying makeup torque while extending the pipe string. In some embodiments of the present disclosure, the pipe gripper is arranged to screw a pipe together with another pipe during the assembling of a pipe stand and to reverse the process when disassembling the pipe string or pipe stand using breakout torque. The pipe-gripper may hold the pipe or a pipe stand to orient and move the pipe or pipe stand. The pipe gripper may be connected to a manipulator arm using a manipulator arm joint.

In some embodiments, the pipe-gripper includes an elongated housing within which a rotor is positioned. The rotor may extend through openings in the elongated housing. A longitudinal groove extends along a length of the rotor and may be arranged to accommodate at least a portion of a pipe or a pipe stand (referred to herein collectively as "pipe"). In certain embodiments, the longitudinal groove may extend the entire length of the rotor. The rotor may be supported within the elongated housing. A bottom portion of the longitudinal groove may have a center axis coinciding with the center axis of the rotor. In a gripping position, in which the pipe-gripper may be moved into engagement with the pipe or pipe stand, an opening in the elongated housing may form a radial extension of the longitudinal groove of the rotor.

The rotor may be provided with an external toothed rim interrupted by the longitudinal groove. A rotor drive may engage with the external toothed rim via a transmission assembly. In certain embodiments, the plurality of driving wheels may have points of engagement with the toothed rim, wherein the points of engagement are spaced apart by a distance that is larger than the width of the mount of the longitudinal groove of the rotor. In these embodiments, at least one gear wheel of the transmission assembly will be in engagement with the toothed rim during operation. The toothed rim may be positioned in an end portion of the rotor.

The rotor may be provided with at least clamp assembly that may engage with a portion of the pipe or the pipe stand when the pipe or pipe stand is placed in the longitudinal groove of the rotor. Each clamp assembly may include at least one clamp. In certain embodiments, the clamp may include at least two dies positioned in a transition between the bottom of the longitudinal groove and the inside face of the longitudinal groove. The dies may be movable along respective guides. In certain embodiments, the guides are ramps in the rotor that may, by axial displacement, result in radial displacement of the dies. The clamps may have the same direction of motion. The clamps may, when engaging with the pipe, move downwardly along the vertical position of the pipe-gripper. In such embodiments, gravity may assist in locking the pipe in the rotor by pulling the dies downwards and inwards towards the center axis of the rotor. At least one set of clamps may be connected via a clamp transmission to an actuator positioned in the elongated housing. In certain embodiments, each clamp assembly is connected to a separate actuator. In such embodiments, the clamp assemblies may engage with the pipe despite variations in pipe diameter, wear on the dies, and deformation of the guide tracks. The actuator may be a second drive motor that is connected, via a clamp transmission, positioned part in the elongated housing to threaded rods. The threaded rods may extend in an axial direction into engagement with the dies. Engagement with the dies may be made by threaded holes in axially displaceable carriers. A decoupler motor may be adapted to rotate a drive coupling to disengage the second drive gear from the drive actuator such that the rotor may be rotated freely relative to the drive motor.

In another embodiment, the dies are connected to brace rods positioned in the axial direction of the rotor and connected to a mounting that is rotatable around the center axis of the rotor. The mounting may be axially displaceable using a linear actuator such as a linear motor.

In certain embodiments where a plurality of sets of clamps are connected to the same actuator, a resilient element is position in a connection between each set of clamps and the transmission. A sufficient pressure may be achieved from each set of clamps against the pipe to be held fixed. The resilient element may be formed as a coupling element for the threaded rods or brace rods of the pipe grippers. The coupling elements may be displaceable in the axial direction of the rotor against tensioned springs.

The pipe-gripper may include a joint for a rotatable connection to a manipulator having several degrees of freedom for manoeuvring the pipe-gripper within a work area. The mounting is arranged in a middle portion of the elongated housing.

The toothed rim may be arranged at an end portion of the rotor.

The dies of each clamp may be displaceable along the ramps arranged in the rotor, each ramp having the dip direction towards the same end portion of the rotor.

The ramps may dip radially outwards in the axial direction of the rotor away from, in the vertical position of application of the pipe-gripper, lower end portion of the rotor.

The die actuator may be formed as a second drive motor that is arranged in the elongated housing and is connected via a plurality of gear wheels to threaded rods that are each in engagement with a respective die, and a remote-controlled drive coupling forms an interface between the elongated housing and the rotor.

Several clamps may be connected to the same die actuator. Alternatively, several clamps may be connected to the same die actuator via a resilient coupling element connected to the dies. Alternatively, each clamp may be connected to a separate die actuator.

BRIEF DESCRIPTION OF THE DRAWINGS

The present disclosure is best understood from the following detailed description when read with the accompanying figures. It is emphasized that, in accordance with the stand practice in the industry, various features are not drawn to scale. In fact, the dimensions of the various features may be arbitrarily reduced for clarity of discussion.

DETAILED DESCRIPTION OF THE DRAWINGS

Figure 1:
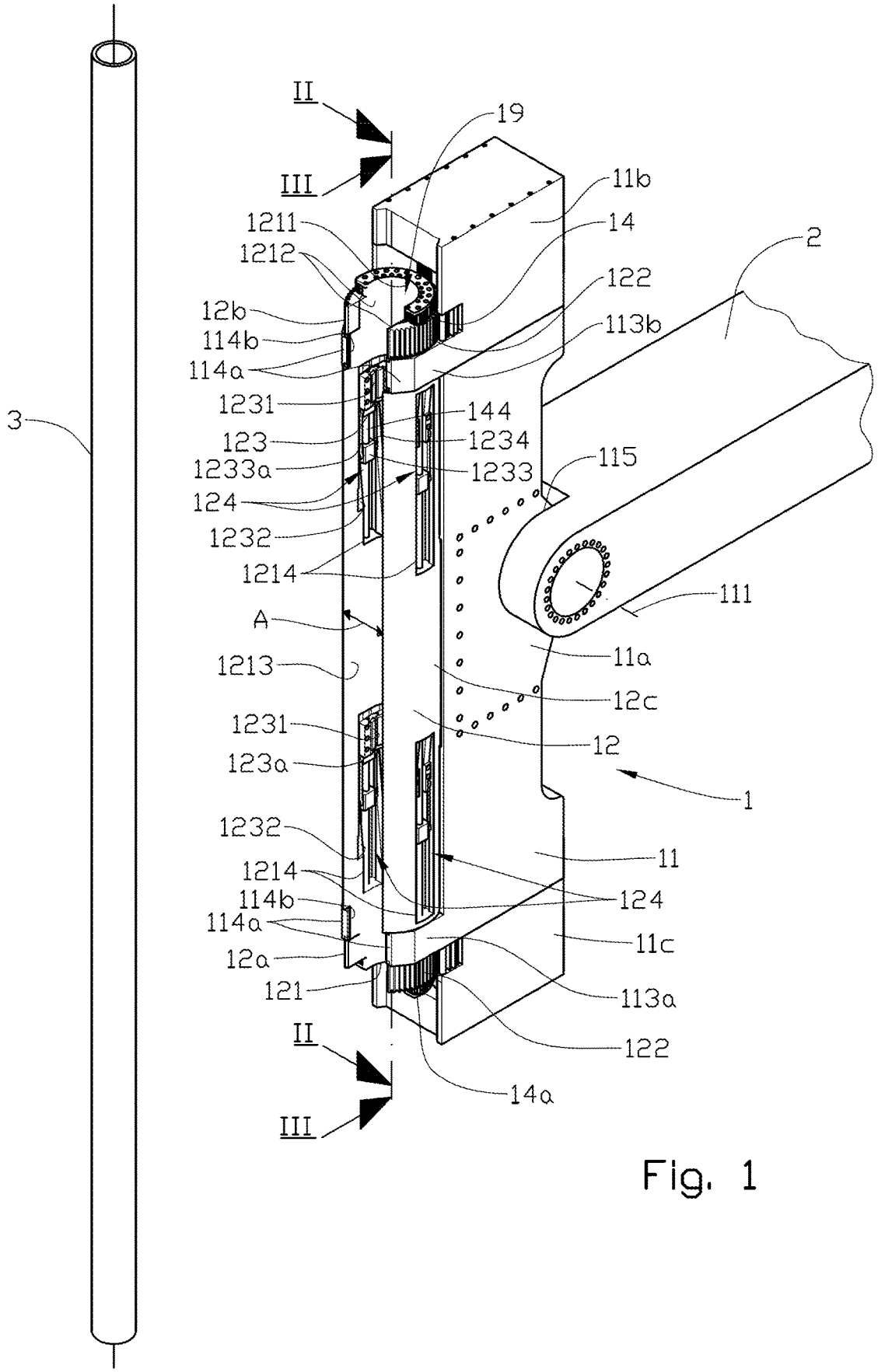
FIG. 1 shows, in perspective, a pipe-gripper connected to a manipulator arm consistent with certain embodiments of the present disclosure.

The following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Reference is first made to FIG. 1, in which pipe-gripper 1 is mechanically connected to manipulator arm 2, shown in FIG. 1, arranged to move pipe 3. The pipe-gripper 1 includes an elongated housing 11 which, in a middle portion 11*a*, is provided with manipulator arm joint 115. The manipulator arm joint 115 is adapted to move pipe gripper 1 about rotation axis 111, allowing the pipe gripper 1 to hold the pipe 3 in positions about the rotation axis 111. The pipe manipulator attached to the manipulator arm joint 115 may allow movement of the pipe gripper 1 from horizontal to vertical in 3-D space. The rotor 12 is positioned within the elongated housing 11. A rotor 12 is radially and axially supported at its end portions 12*a*, 12*b* in first and second rotor bearings 113*a*, 113*b* projecting from the housing 11. The first and second rotor bearing 113*a*, 113*b* allow rotation of the rotor 12 with respect to the elongated housing 11 and is formed as separate supports 114*a* defining, at their outer ends, a mouth 114*b*.

Figures 3, 3A, 3B:
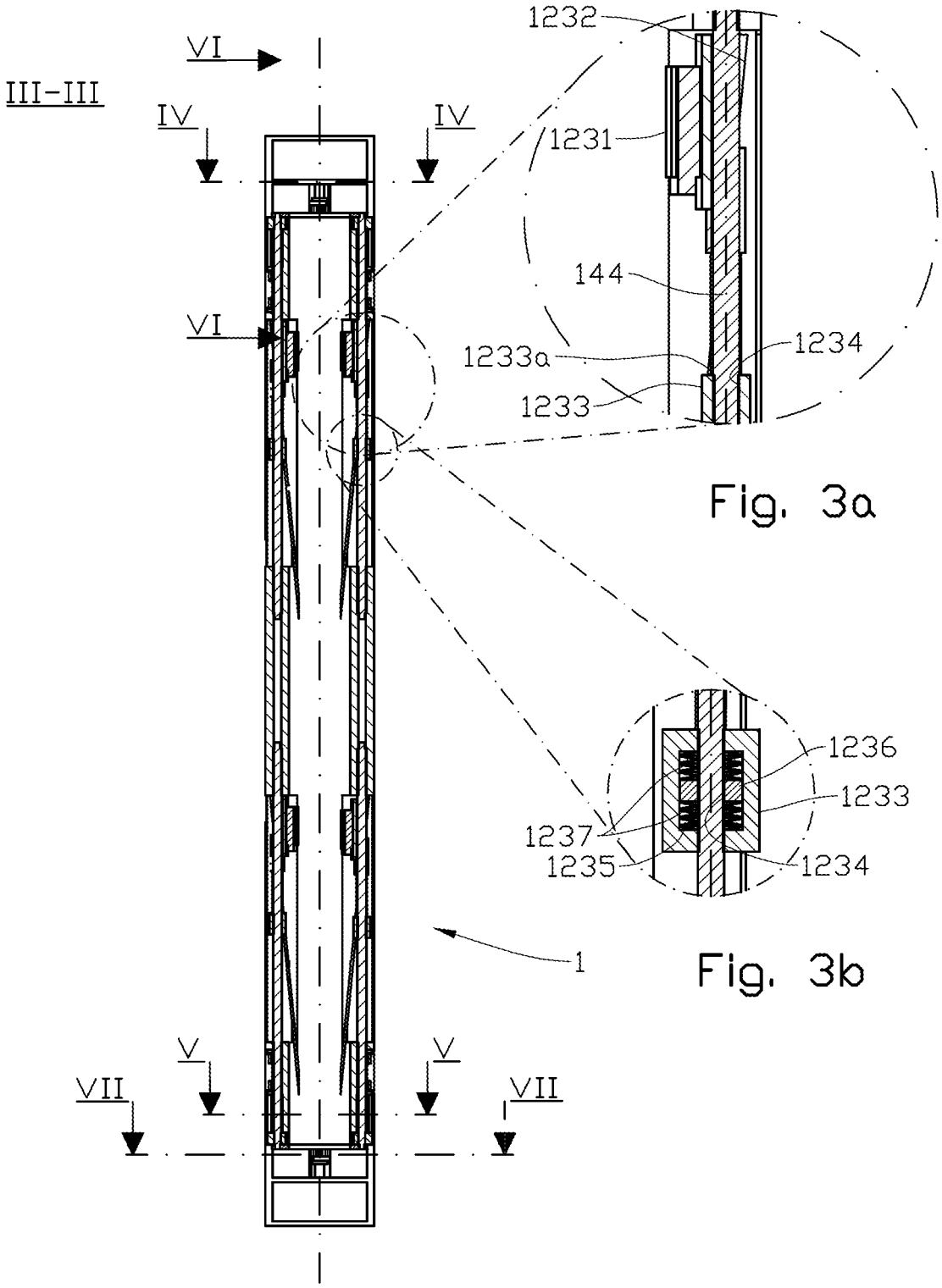
FIG. 3 shows an axial section through the pipe-gripper according to III-III of FIG. 1.
FIG. 3*a* shows a section of FIG. 3.
FIG. 3*b* shows a section of FIG. 3 consistent with certain embodiments of the present disclosure.

The rotor 12, which may have a circular periphery 12*c*, is provided with longitudinal groove 121 extending axially through the rotor 12. In certain embodiments, the longitudinal groove 121 may be U-shaped, C-shaped or squared off. From, and tangentially to, a semi-circular bottom portion 1211 with a center axis coinciding with the center axis of the rotor 12, two parallel side faces 1212 extend to the circular periphery of the rotor, where a groove mouth 1213 having a rotor mouth distance A is formed therefrom. The end portions 12*a*, 12*b* of the rotor 12 are each provided with an external toothed rim 122 broken by the longitudinal groove 121. In a gripping position, in which the pipe-gripper 1 may be moved into engagement with a pipe 3, an opening 19 in the elongated housing 11 may form an axial extension of longitudinal groove 121.As further shown in FIG. 1, a top clamp assembly 123 and a bottom clamp assembly 123*a* may be positioned within the rotor 12 and may hold pipe 3 fixed in the rotor 12. In other embodiments, only one clamp assembly (123 or 123*a*) may be used, such as for short tubulars. In other embodiments, three or more clamp assemblies may be used. The clamp assembly 123, 123*a* may also be positioned anywhere along rotor 12. For purposes of this disclosure, "clamp assembly" refers to one or more clamps. As shown in FIG. 1, each clamp assembly 123, 123*a* has two clamps 124. As further shown in FIG. 1, each clamp 124 within, for example, the top clamp assembly 123 may be positioned opposite the other clamp 124 at parallel side faces 1212. Each of the clamps 124 may include cut-outs 1214 in the rotor 12 in which guides 1232 may be formed. The guides 1232 may be ramps dipping radially outwards in the direction of a second end portion 12*b* of the rotor 12. Dies 1231, positioned within the guides 1232 are displaceable towards a center line of the rotor within the guides 1232. As shown in FIG. 3*a*, each die 1231 may be connected to carrier 1233 via a plurality of articulated arms 1233*a*. In carrier 1233, a threaded hole 1234 may be arranged for receiving a threaded rod 144, as described below.

Figure 2:
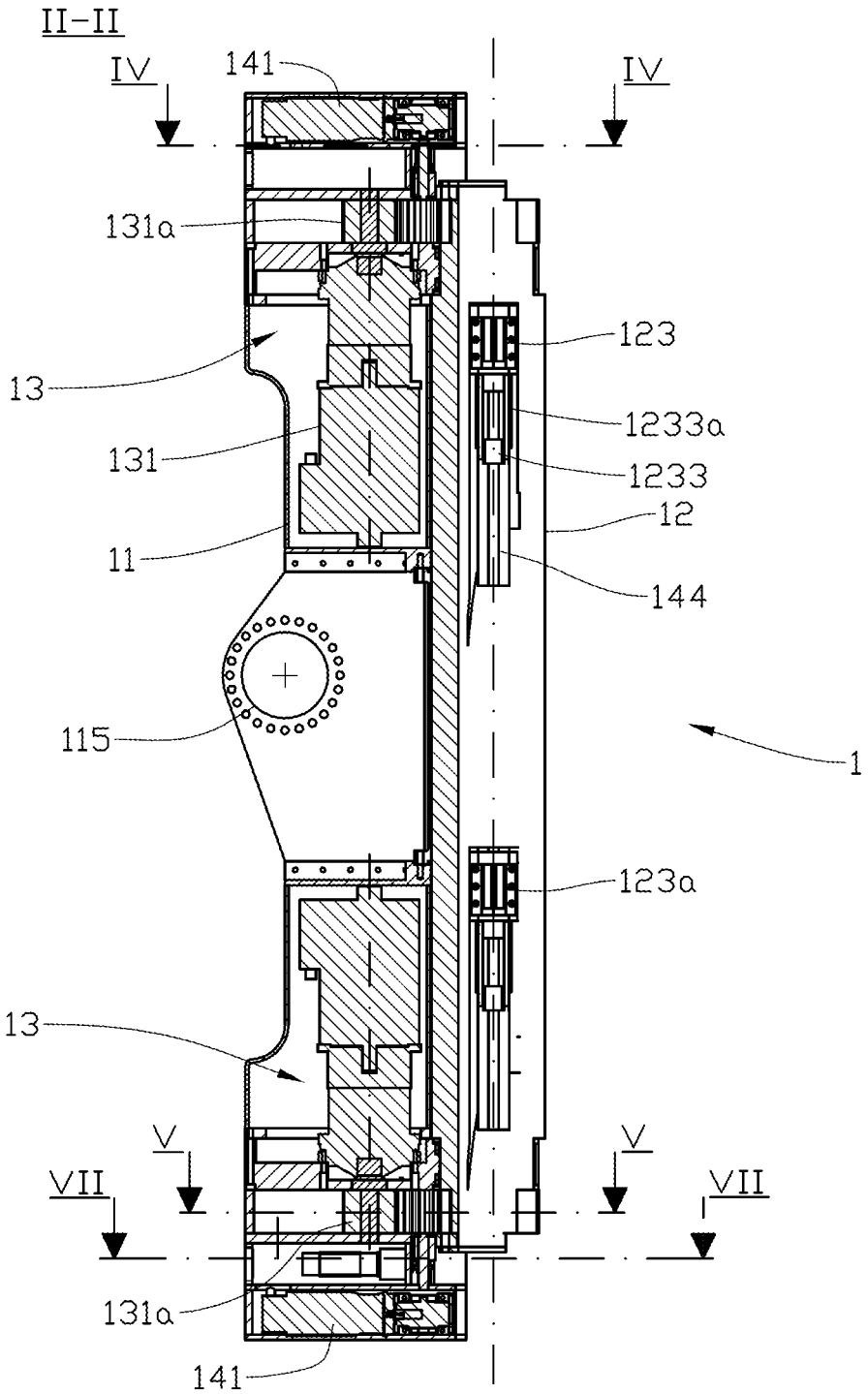
FIG. 2 shows an axial section through the pipe-gripper according to II-II of FIG. 1.
Figure 5:
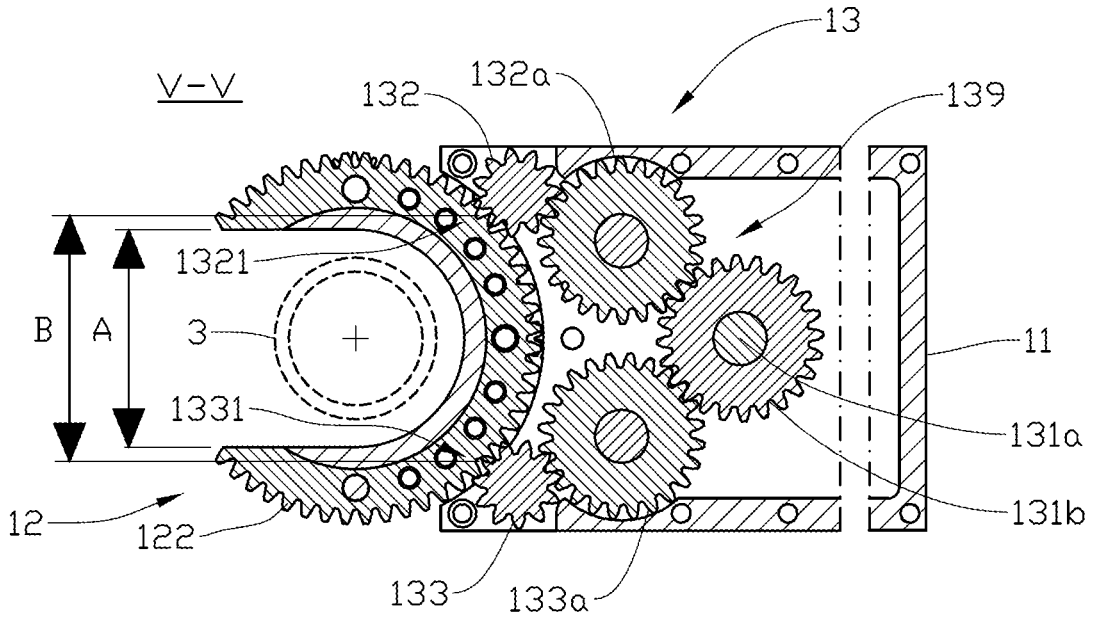
FIG. 5 shows a cross section V-V according to FIGS. 2 and 3.
Figure 5A:
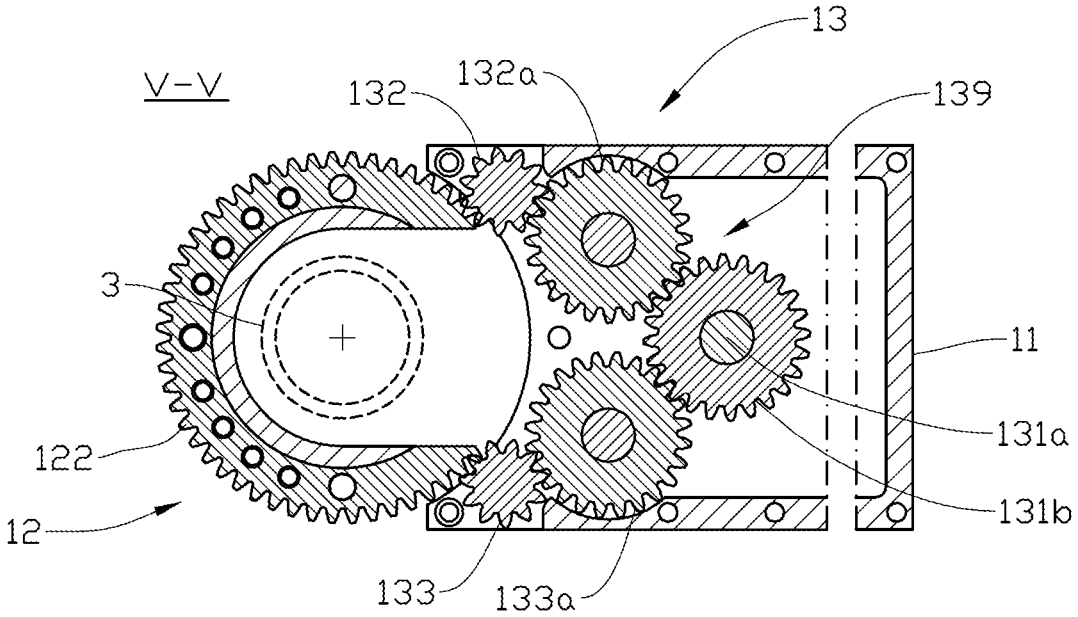
FIG. 5*a* shows a cross section corresponding to that of FIG. 5 with the rotor rotated by 180°.

An embodiment of the present disclosure is presented in FIGS. 2 and 5. As shown in FIGS. 2 and 5, a plurality of rotor drives 13 are positioned in end portions 11*b*, 11*c* of the elongated housing 11. In other embodiments, a single rotor drive 13 may be used. A drive shaft 131*a*, having, for example, toothed wheel 131*b*, may engage with a transmission assembly 139. In some embodiments, the transmission assembly 139 may include gear wheels 132*a*, 133*a*, shown in FIGS. 5 and 5*a*, and first and second driving wheels 132, 133. The gear wheels 132*a*, 133*a* may engage first and second driving wheels 132, 133, respectively, shown as toothed wheels. First and second driving wheels 132, 133 are engaged with the toothed rim 122, forming toothed-rim engagement points 1321, 1331 spaced apart by an engagement distance B (see FIG. 5). The engagement distance B is larger than the rotor mouth width A of the rotor 12, which may allow engagement point 1321 or 1331 to be engaged as the toothed rim 122 rotates. FIG. 5*a* depicts a cross section corresponding to that of FIG. 5 with rotor 12 rotated by 180°. In certain other embodiments, the rotor 12 may include only one toothed rim 122 and one rotor drive 13. Thus, the first drive motor 131, shown in FIG. 2 is engaged with the toothed rim 122 of the rotor 12. The transmission assembly 139 may include, in place of one or more gear wheels, roller chains and/or toothed belts.

Reference is now made to FIGS. 1, 4, 6, and 7. FIGS. 1, 4, 6, and 7, depict first and second die actuators 14, 14*a*, which are arranged in end portions of the pipe gripper 1 and are each in engagement with the clamps 123, 123*a*. The first and second die actuators 14, 14*a* include a second drive motor 141. The second drive motor 141 may be in engagement with a second drive gear 145. The second drive gear 145 which, via a clamp transmission 149, and the threaded rod 144, is in engagement with the clamps 123 or 123*a*. The clamp transmission 149 includes a clamp actuator gear 147, which is engagement with one or more secondary gears 147*a*, which are in engagement with threaded rod gears 143. The threaded rod gears 143 surround and engage the threaded rods 144. A second drive motor 141 is positioned in the elongated housing 11. Therefore, the second drive motor 141 is in engagement with the plurality of threaded rods 144 extending in the axial direction of the rotor 12 into engagement with the threaded holes 1234 of the carriers 1233. In other embodiments, the rotor 12 may include a plurality of clamps 123, 123*a* that are connected to a single die actuator 14.

Figure 4:
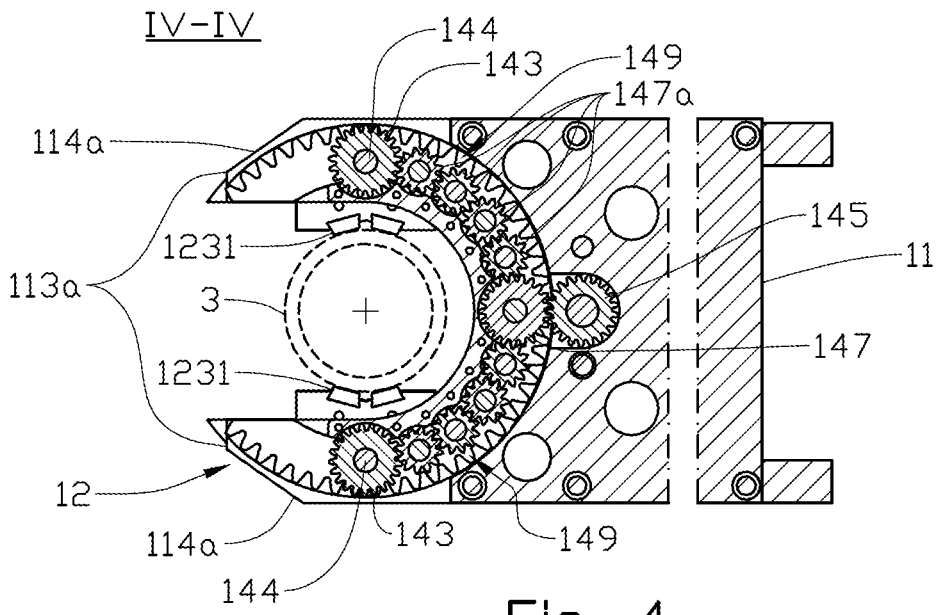
FIG. 4 shows a cross section IV-IV according to FIGS. 2 and 3.
Figure 6:
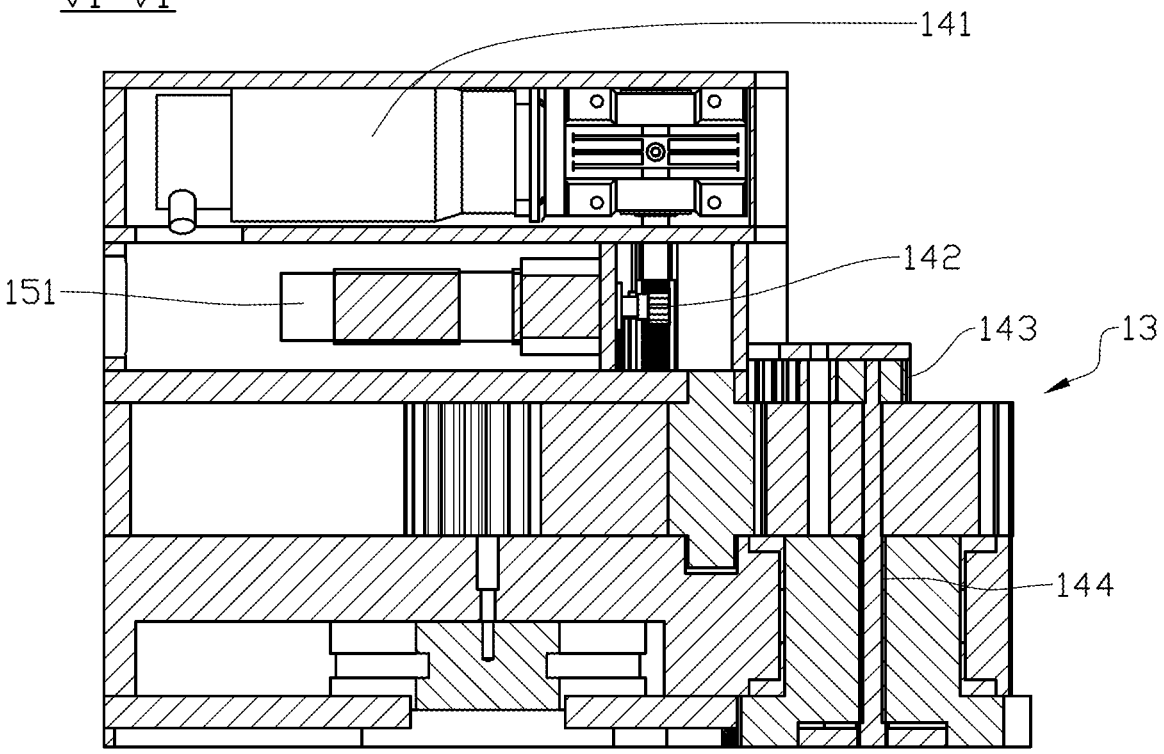
FIG. 6 shows a longitudinal section VI-VI according to FIG. 3.
Figure 7:
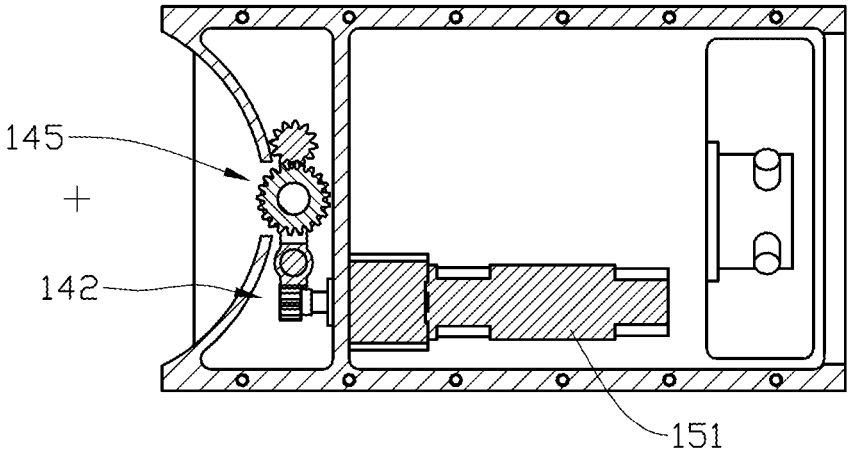
FIG. 7 shows a cross section VII-VII according to FIGS. 2 and 3.

FIGS. 4, 6, and 7 illustrate engagement of the second drive gear 145 with the clamp actuator gear 147. A decoupler motor 151 is adapted to rotate a drive coupling 142 to raise and lower the second drive gear 145, thereby engaging or disengaging the second drive gear 145 with the clamp actuator gear 147.

The coupling 1238 between the die actuator 14 and the carriers 1233 is resilient, for example as shown in FIG. 3*b*, in which the threaded hole 1234 is arranged in a coupling 1236, which is positioned in a recess 1235 in the carrier 1233 between two sets of springs 1237, shown as disc springs. Variations in pipe diameter and die dimensions may be equalized so that the clamps devices 123, 123*a* apply approximately the same clamping force to the pipe 3.

The pipe-gripper 1 may be mechanically connected to the manipulator arm 2 and electrically connected via wires to a power source for the supply of energy to the drive motor 131 of the rotor drives 13 and the drive motor 141 and drive couplings 142 of the actuators 14, 14*a*. When the rotor 12 has been rotated such that the groove mouth 1213 coincides with the mouths 114*b* of the rotor bearings 113*a*, 113*b*, the pipe-gripper 1 is moved onto a portion of the pipe 3. The drive couplings 142 of the die actuators 14, 14*a* are activated and the dies 1231 of the clamps 123, 123*a* are moved into engagement with the pipe 3 by the threaded rods 144 being rotated with the respective second drive motors 141. The drive couplings 142 are deactivated so that the second drive motors 141 are uncoupled from the rotor 12.

The pipe manipulator arm 2 positions the pipe 3 relative to a pipe string to which the pipe 3 is to be joined. The rotor 12 is put into rotation by means of the first drive motors 131 for joining the pipe 3 and the pipe string. The pipe-gripper 1 is so dimensioned that making up the pipe joint to the prescribed torque is carried out by the pipe-gripper 1. In certain embodiments, the make-up/break out torque may be between 2,000 and 60,000 ft-lbs, or between 5,000 and 40,000 ft-lbs. The pipe-gripper of the present disclosure is capable of providing the make-up/break out torque, unlike traditional pipe-grippers that are incapable of providing such high levels of torque. The pipe-gripper 1 may also resist up to 60,000 ft-lbs if another machine applies the make-up or breakout torque. Correspondingly, the pipe-gripper 1 may be used when a pipe joint is to be broken out and a pipe 3 removed from the pipe string.

Figure 8:
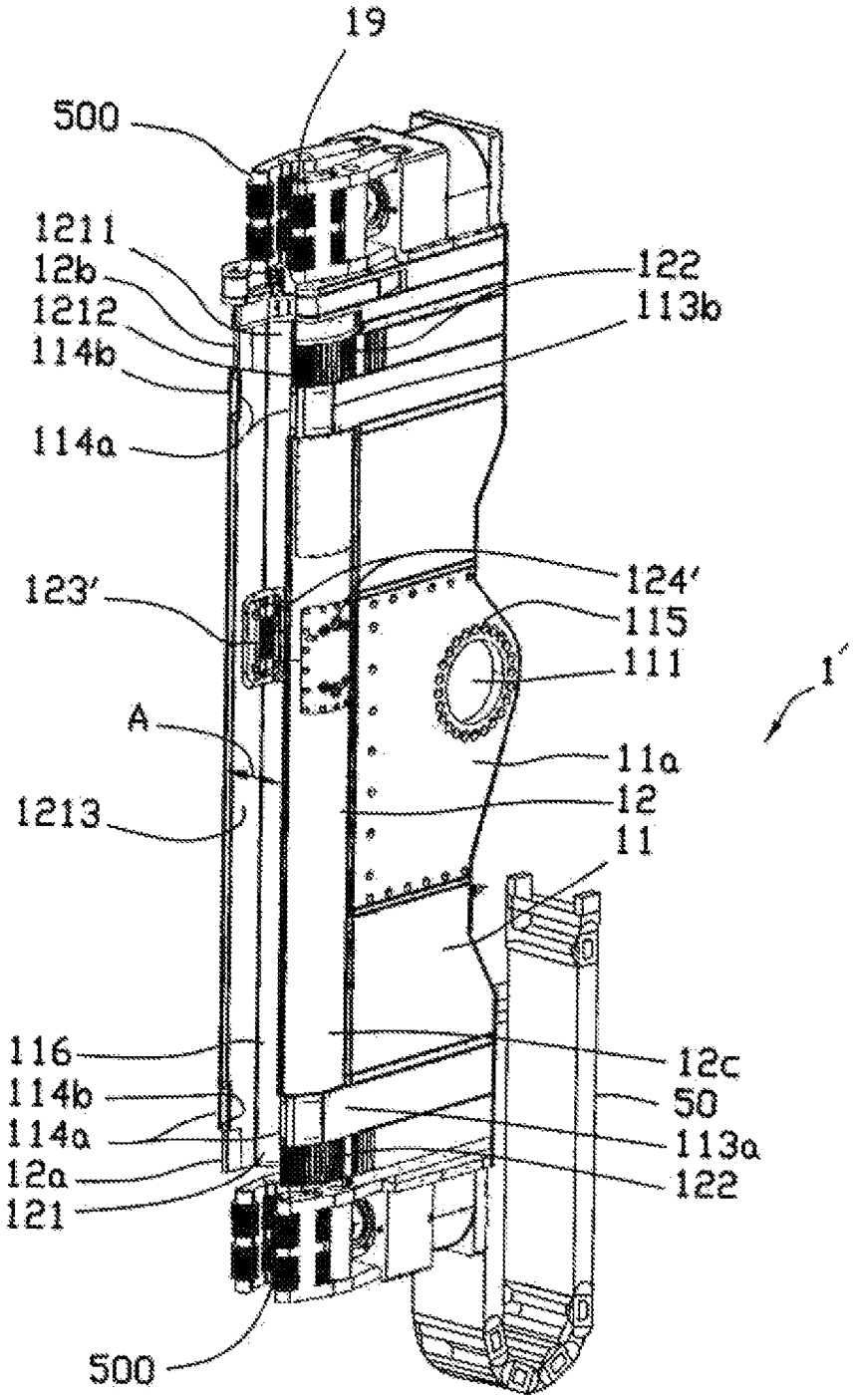
FIG. 8 shows in perspective a pipe-gripper consistent with certain embodiments of the present disclosure.

Reference is next made to FIG. 8, in which pipe-gripper 1' may be mechanically connected to a manipulator arm 2, shown in FIG. 1, arranged to move the pipe 3. The pipe-gripper 1' includes an elongated housing 11 which, in a middle portion 11*a*, is provided with a manipulator arm joint 115. The manipulator arm joint 115 is adapted to move the pipe gripper 1' about a rotation axis 111, allowing the pipe gripper 1' to hold the pipe 3 in positions about rotation axis 111. The pipe manipulator attached to a manipulator arm joint 115 may allow movement of the pipe gripper 1' from horizontal to vertical in 3-D space. The rotor 12 is positioned within an elongated housing 11. The rotor 12 is radially and axially supported at first and second rotor bearings 113*a*, 113*b*, within which are bearings that allowing rotation at supports 114*a*. The rotor bearings 113*a*, 113*b* allow rotation of the rotor 12 with respect to the elongated housing 11. The supports 114*a* define, at their outer ends, a mouth 114*b*.

The rotor 12 is provided with a longitudinal groove 121 extending axially through the rotor 12. The rotor 12 may have a circular periphery 12*c*. In certain embodiments, the longitudinal groove 121 may be U-shaped, C-shaped or squared off. From, and tangentially to, a semi-circular bottom portion 1211 with a center axis coinciding with the center axis of the rotor 12, two parallel side faces 1212 extend to the circular periphery of the rotor, where a groove mouth 1213 having a rotor mouth distance A is formed therefrom. The end portions 12*a*, 12*b* of the rotor 12 are each provided with an external toothed rim 122 broken by the longitudinal groove 121. In a gripping position, in which the pipe-gripper 1 may be moved into engagement with a pipe 3, the opening 19 in the elongated housing 11 may form an axial extension of longitudinal groove 121.

As further shown in FIG. 8, a clamp assembly 123' may be positioned within the rotor 12 and may hold the pipe 3 fixed in the rotor 12. The clamp assembly 123' may grip the pipe 3 at the box end of the pipe 3, the pin end of the pipe 3, or both. In other embodiments, two or more clamp assemblies 123' may be used. In the embodiment shown in FIG. 8, the clamp assembly 123' is shown near the middle of the longitudinal groove 121. In other embodiments, such as where multiple clamp assemblies are used, the clamp assemblies 123' may be located at other positions along the longitudinal groove 121. For purposes of this disclosure, "clamp assembly" refers to one or more clamps. As shown in the present figures, the clamp assembly 123' has two clamps 124'. As further shown in FIG. 8, each clamp 124' within, for example, the clamp assembly 123' may be positioned opposite the other clamp 124' at parallel side face 1212.

Figure 9:
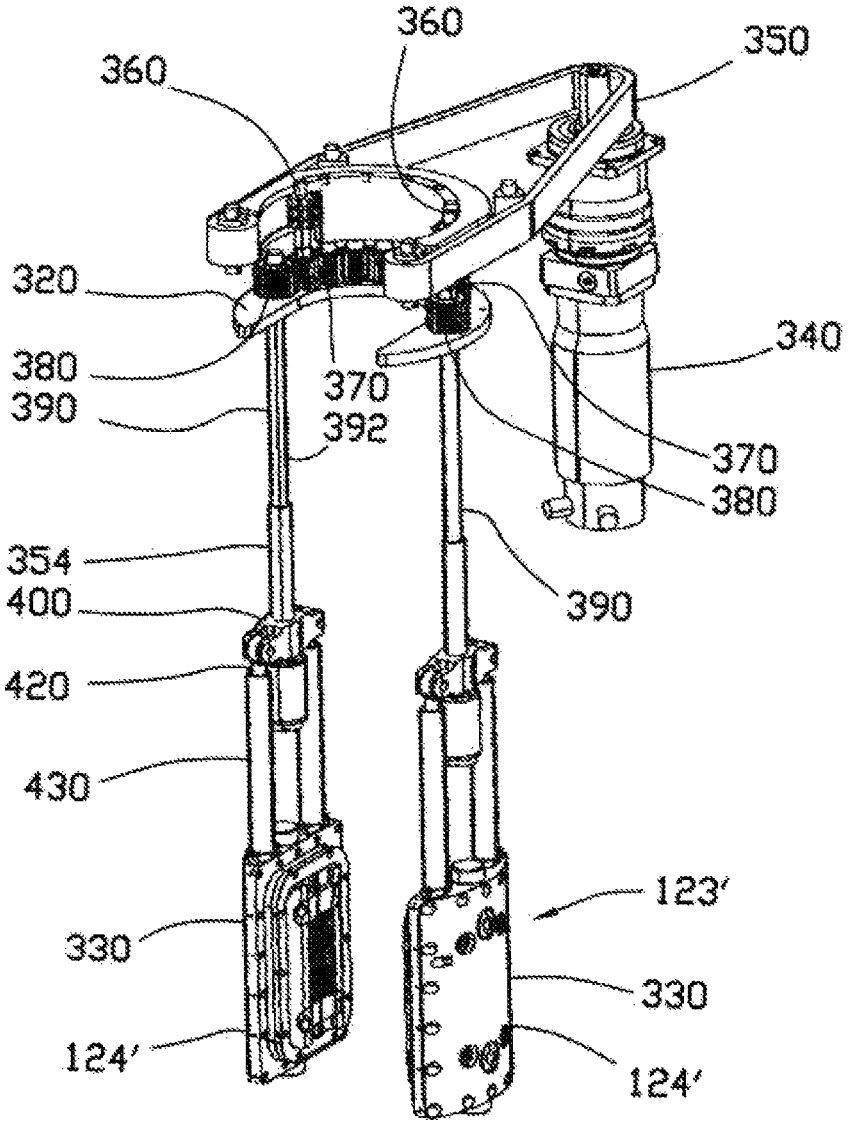
FIG. 9 shows an isolation view of the pipe-gripper's clamp assembly consistent with certain embodiments of the present disclosure.

FIG. 9 is an isolation view of a portion of pipe-gripper 1' depicting the clamp assembly 123' in conjunction with a clamp drive assembly 320. The clamps 124' include a clamp housing 330. A clamp drive assembly 320 includes a clamp drive 340 to which a chain or a belt 350 is wound about. The chain or the belt 350 may engage with chain drive sprockets 360. The chain drive sprockets 360 may be connected to drive gears 370 positioned in a plane above or below the chain drive sprockets 360. As further shown in FIG. 9, the drive gears 370 may engage with clamp drive gears 380. Jack screws 390 are perpendicularly connected to the clamp drive gears 380 such that when the clamp drive gears are rotated, the jack screws 390 also rotate. The jack screws 390 may include a threaded portion 394 and an unthreaded portion 392. The threaded portion 394 may threadedly engage with internal threads on a threaded yoke 400 and be coupled to a bearing assembly 410, which serves to attach the jack screw 390 to the threaded yoke 400. Pistons 420 extend from the threaded yoke 400 and into clamp cylinders 430. Thus, when the clamp drive is engaged, the chain or the belt 350 rotates the chain drive sprockets 360. In certain embodiments, only one chain drive sprocket 360 is used. The chain drive sprockets 360 rotate the drive gears 370, thereby rotating the clamp drive gears 380. The clamp drive gears 380 rotate the jack screw 390 through the internal threads of the threaded yoke 400. By threading the jack screw 390 further into the threaded yoke 400, the piston 420 is retracted from the clamp cylinder 430. The threading jack screw 390 in the opposite direction, i.e. out of the threaded yoke 400, extends the piston 420 into the clamp cylinder 430.

Figure 11A:
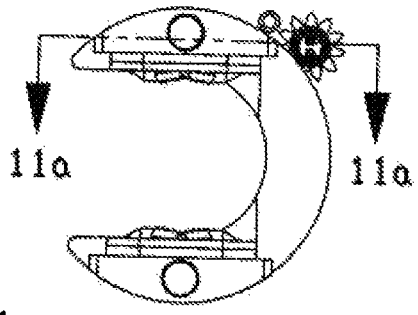
FIG. 11*a* shows a top view of an embodiment of the pipe-gripper's clamp assembly consistent with certain embodiments of the present disclosure.
Figure 11B:
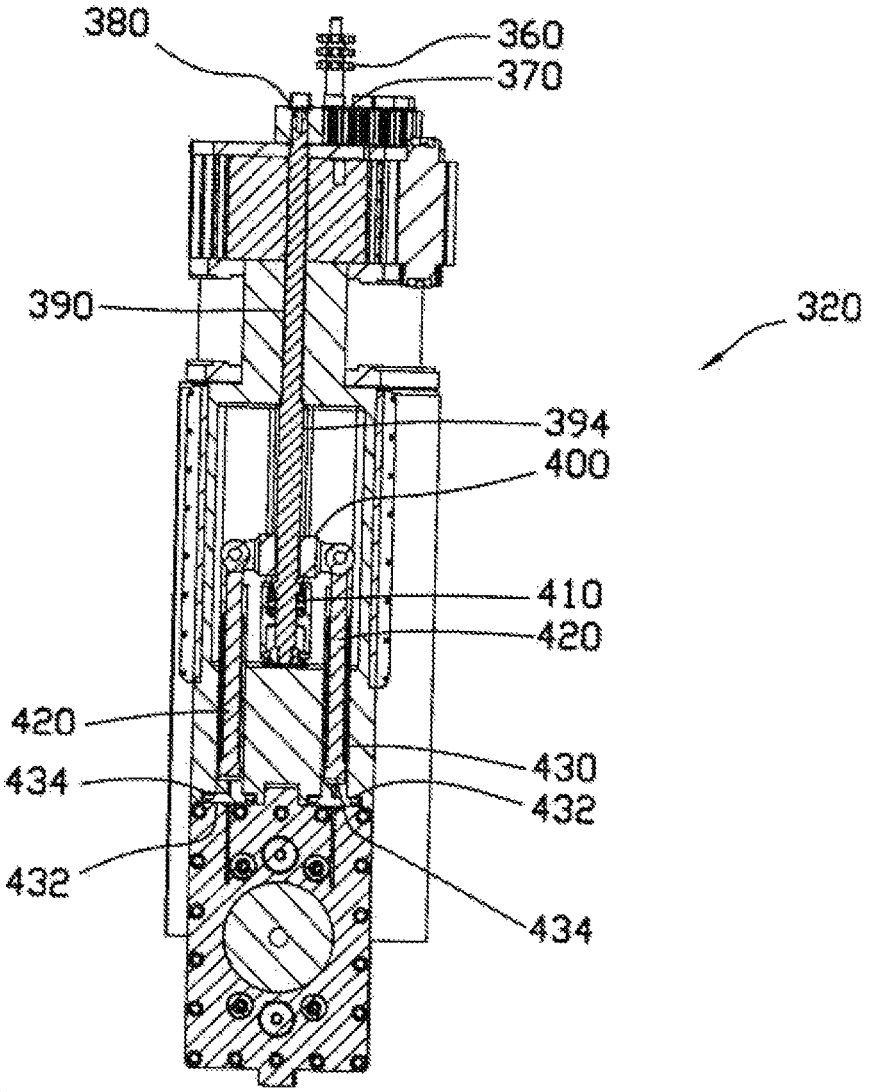
FIG. 11*b* shows an axial-sectional view XI-XI of the pipe-gripper's clamp assembly according to FIG. 11*a*

FIG. 11 is a cross-sectional axial view of a portion of the clamp drive assembly 320. FIG. 11 further depicts discharge ports 432. As the piston 420 extend into the clamp cylinders 430, hydraulic fluid is displaced through the ports 432. The combined area of bottom portions 434 of the pistons 420 is defined as area C.

Figure 10:
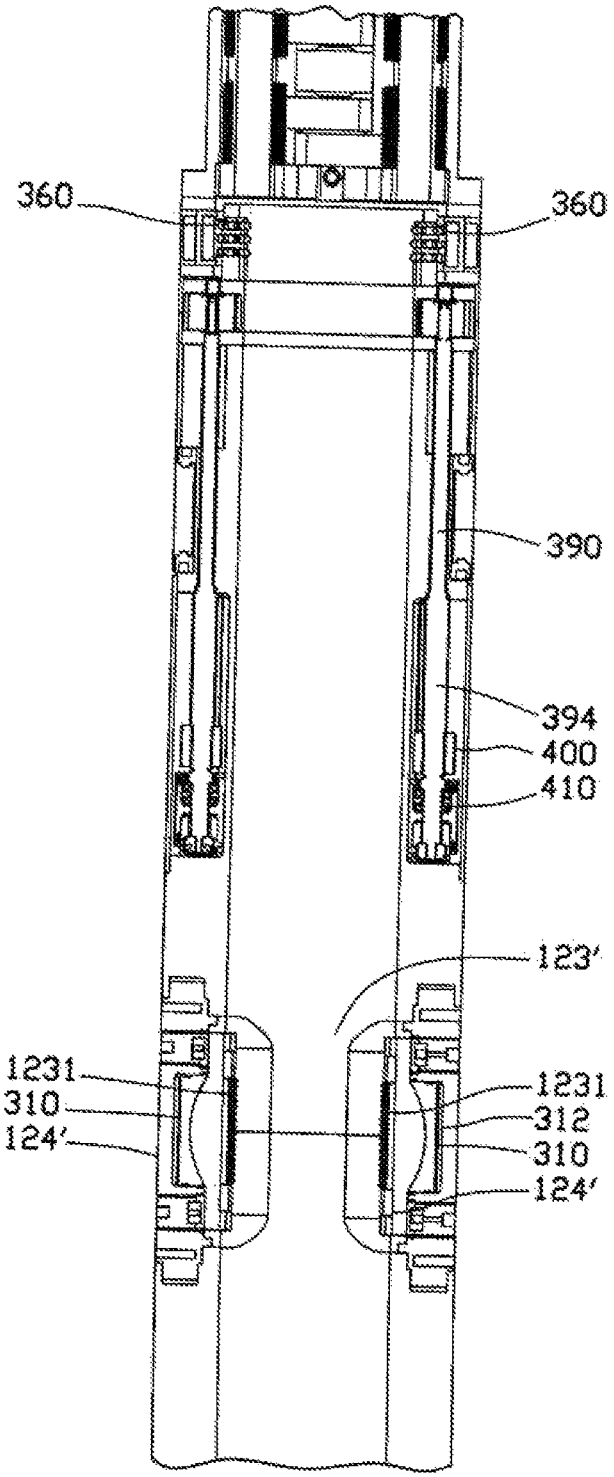
FIG. 10 shows a cross section according to FIG. 8 consistent with certain embodiments of the present disclosure

FIG. 10 is an axial cross-section of the rotor 12 depicting the clamp assembly 123'. Each clamp 124' includes a die 1231, which is displaceable towards a center line of the rotor 12. The die 1231 may be mechanically coupled to a clamp hydraulic cylinder 310. The clamp hydraulic cylinder 310 is in fluid connection with the clamp cylinder 430 forming a closed-loop hydraulic system. As the pistons 420 are extended into the clamp cylinders 430, hydraulic fluid is forced from the clamp cylinders 430 through the ports 432 into the clamp hydraulic cylinders 310, thereby displacing the dies 1231 towards the center line of the rotor 12. When the pistons 420 are retracted from the clamp cylinders 430, the die 1231 may be biased such that it retracts away from the center line of the rotor 12 when hydraulic fluid flows back into the clamp cylinders 430. The die face 312 may have area D. In certain embodiments of the present disclosure, area D may be greater than area C, such that through hydraulic advantage, the force exerted by the die 1231 against the pipe 3 may be greater than that exerted by the pistons 420. In some embodiments, the ratio of area D to area C may be between 10:1 and 30:1 or between 15:1 to 25:1 in non-limiting examples.

When the clamping force is sufficient to retain the pipe 3, rotations of the jack screw 390 may cease and the clamp drive 340 is allowed to freewheel, enabling rotation of the rotor 12 without rotating the jack screw 390.

As shown in FIGS. 2 and 5, a plurality of rotor drives 13 are positioned in the end portions 11*b*, 11*c* of the elongated housing 11. In other embodiments, a single rotor drive 13 may be used. The drive shaft 131*a*, having, for example, the toothed wheel 131*b*, may engage with the transmission assembly 139. In some embodiments, the transmission assembly 139 may include the gear wheels 132*a*, 133*a*, shown in FIGS. 5 and 5*a*, and first and second driving wheels 132, 133. The gear wheels 132*a*, 133*a* may engage the first and second driving wheels 132, 133, respectively, shown as toothed wheels. The first and second driving wheels 132, 133 are engaged with toothed rim 122, forming toothed-rim engagement points 1321, 1331 spaced apart by engagement distance B (see FIG. 5). The engagement distance B is larger than the rotor mouth width A of the rotor 12, which may allow engagement point 1321 or 1331 to be engaged as the toothed rim 122 rotates. FIG. 5*a* depicts a cross section corresponding to that of FIG. 5 with the rotor 12 rotated by 180°. In certain other embodiments, the rotor 12 may include only one toothed rim 122 and one rotor drive 13. Thus, the first drive motor 131, shown in FIG. 2 is engaged with a toothed rim 122 of the rotor 12. Transmission assembly 139 may include, in place of one or more gear wheels, roller chains and/or toothed belts.

In certain non-limiting embodiments, one or more grabbers 500 may be affixed to the elongated housing 11. The grabbers 500 may be adapted to rotatably grip the pipe 3, such as when the pipe gripper 1' is moved through 3-D space. "Rotatably grip" refers to the ability to hold the pipe 3 within the rotor 12 while allowing the pipe 3 to be rotated. While two grabbers 500 are shown in FIG. 8, the grabbers 500 may be omitted entirely or only one grabber 500 may be used.

Figure 12:
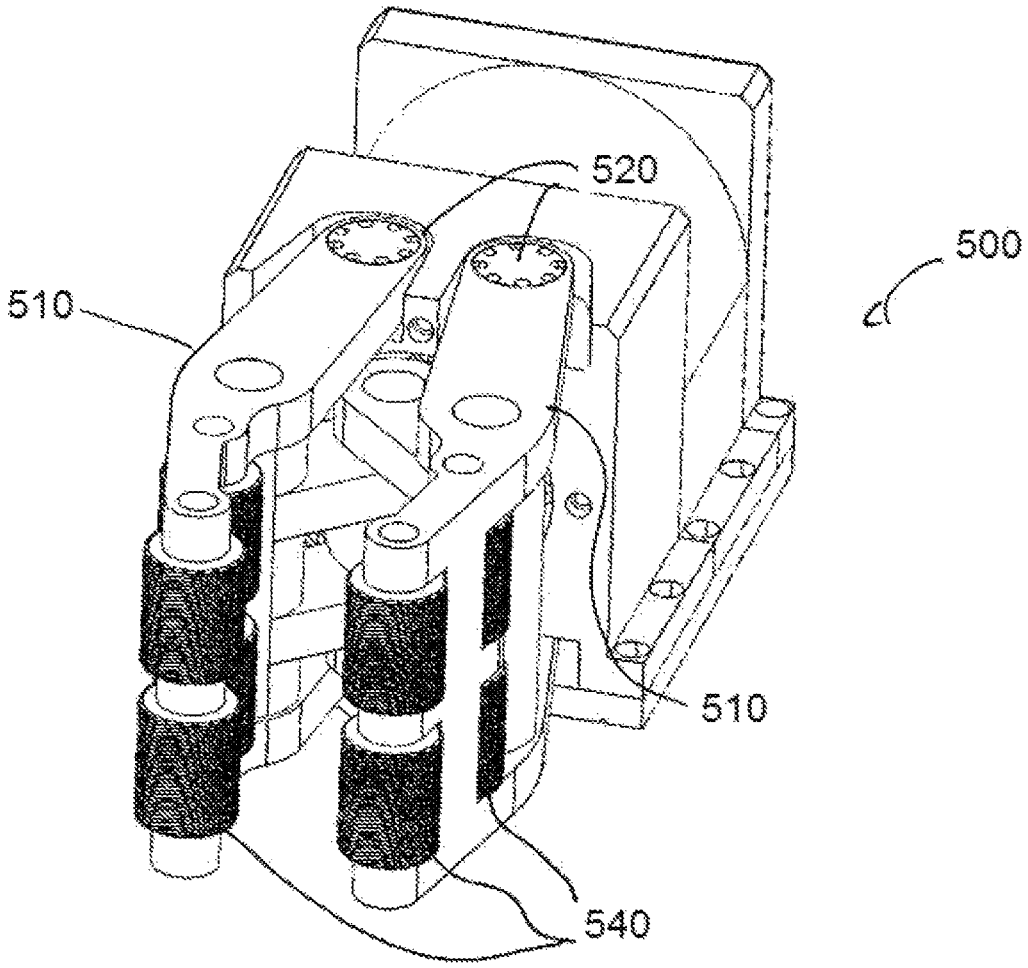
FIG. 12 is an isolation view of a grabber consistent with certain embodiments of the present disclosure
Figure 13:
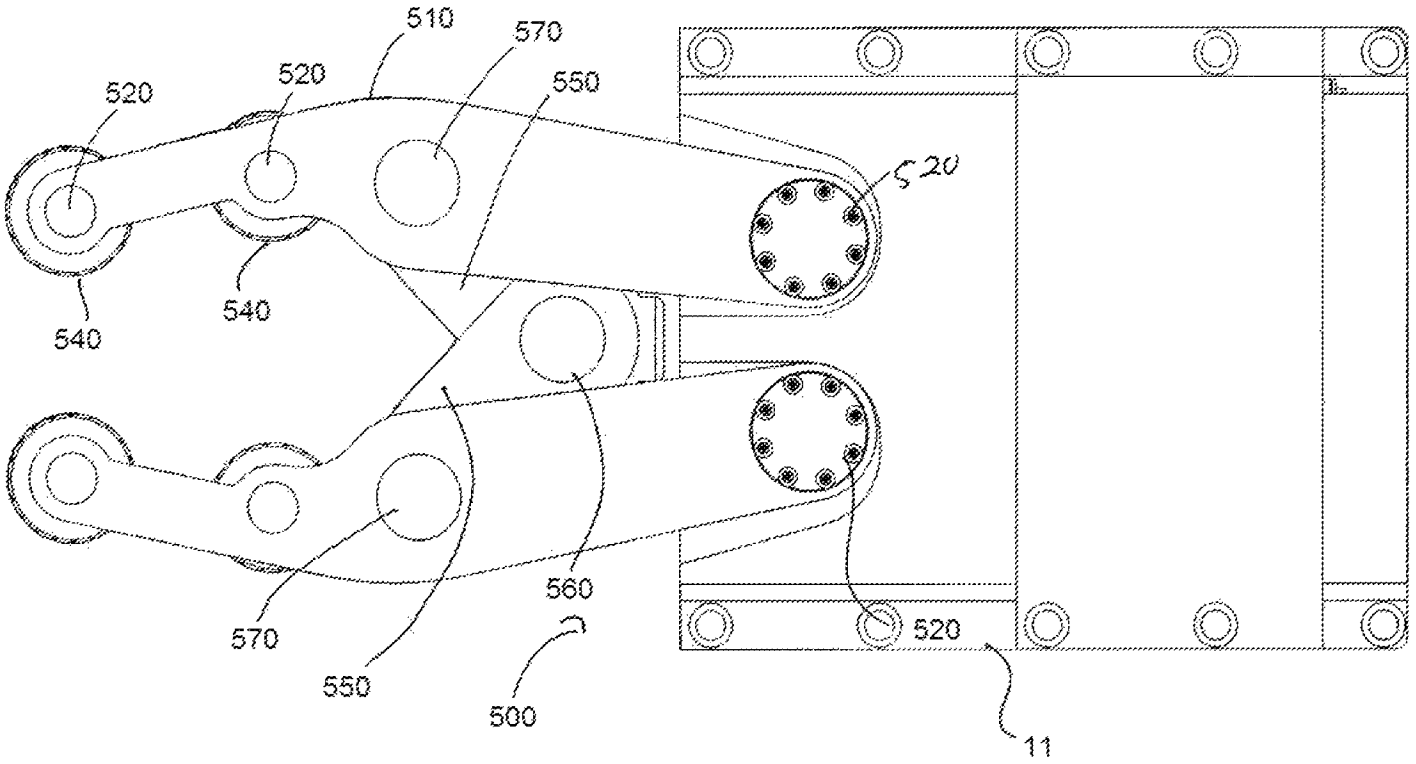
FIG. 13 is a top view of the grabber according to FIG. 12.

FIG. 12 is an isolation view of the grabber 500. The grabber 500 may include grabber arms 510 rotatably connected to the elongated housing 11 at housing attachment points 520. In certain embodiments, the grabber arms 510 may be semi-circular, such that the pipe 3 may be grasped between the grabber arms 510. As shown in FIGS. 12 and 13, a plurality of rollers 540 may be affixed to the grabber arms 510 at rotation points 520 such that the rollers 540 may rotate relative to the grabber arms 510 when the pipe 3 is rotated by the rotor 12. Scissor arms 550 may be connected to the grabber arms 510 at arm pivot points 570. The scissor arms 550 may be joined at scissor pivot point 560.

Figure 14:
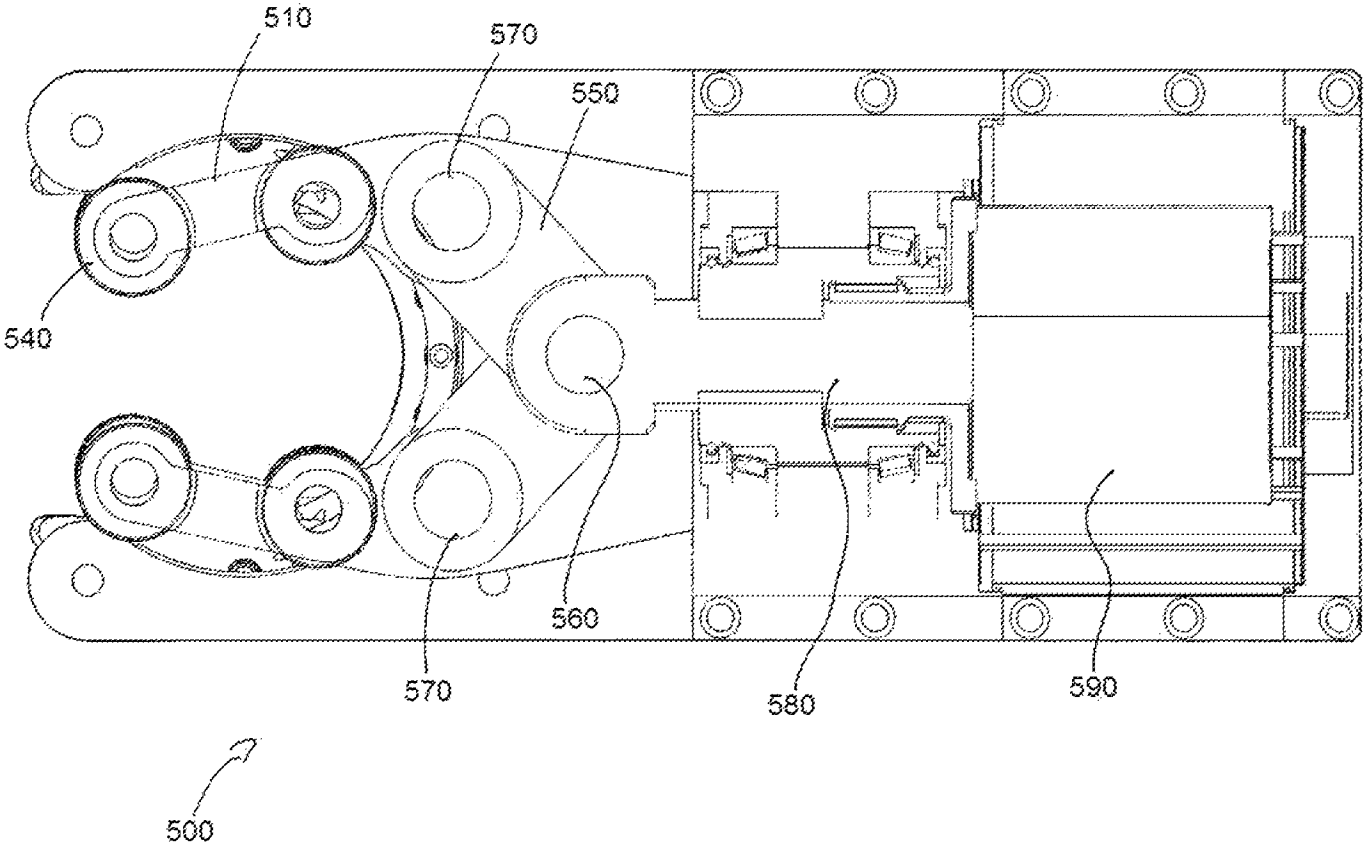
FIG. 14 shows a cut-away top view of the grabber according to FIG. 12.

FIG. 14 shows a cut-away top view of the grabber 500. A motor shaft 580 is mechanically connected to a motor 590 and the scissor arms 550 at the scissor pivot point 560. The motor 590 may extend a motor shaft 580, extending the scissor pivot point 560 towards the center line of the rotor 12, thereby moving the grabber arms 510 away from each other and out of engagement with the pipe 3. The motor 590 may retract the motor shaft 580, retracting the scissor pivot point 560 from the center line of the rotor 12, thereby moving the grabber arms 510 towards each other and into engagement with the pipe 3. In certain embodiments, the motor 590 is electrically actuated. The grabbers 500 may be adapted to take the tubular load of the pipe 3, while the clamp assembly 123' applies and/or resists torque.

The pipe-gripper 1 may be mechanically connected to the manipulator arm 2 and electrically connected via a drag chain 50 to a power source for the supply of energy to the drive motor 131 of the rotor drives 13 and the drive motor 141. When the rotor 12 has been rotated such that the groove mouth 1213 coincides with the mouths 114*b* of the rotor bearings 113*a*, 113*b*, the pipe-gripper 1 is moved onto a portion of the pipe 3. The dies 1231 of the clamp assembly 123' are moved into engagement with the pipe 3.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A pipe-gripper comprising:

an elongated housing;

a rotor, the rotor positioned within the elongated housing, the rotor having a periphery, the rotor having a longitudinal groove extending axially therethrough, the longitudinal groove having a groove mouth, the groove mouth having width A;

a toothed rim, the toothed rim positioned on the periphery of the rotor and interrupted by the longitudinal groove;

a clamp assembly, the clamp assembly comprising at least one clamp and positioned within the rotor;

a rotor drive, the rotor drive positioned within the elongated housing; and a transmission assembly, the transmission assembly in engagement with the rotor drive at toothed rim engagement points, the distance between toothed rim engagement points being distance B, distance B being larger than distance A.

2. The pipe-gripper of claim 1, comprising a top clamp assembly and a bottom clamp assembly or a middle clamp assembly.

3. The pipe gripper of claim 1, wherein each clamp comprises:

a cut-out in the rotor;

a guide, the guide formed within the rotor;

a die, the die positioned within the guide and displaceable in radially to a center-line of the rotor; and a carrier, the die connected to the carrier via an articulated arm, the carrier having a threaded hole.

4. The pipe-gripper of claim 1 further comprising:

a clamp drive engaged with a jackscrew;

a threaded yoke, the threaded yoke threadedly engaged with the jack screw;

a piston mechanically connected to the threaded yoke, the piston positioned within a cylinder;

a clamp hydraulic cylinder in fluid connection with the clamp cylinder; and a die mechanically coupled to the clamp hydraulic cylinder.

5. The pipe gripper of claim 4, wherein the die has a die face of area D, where-in the piston has a bottom portion of area C, and wherein area D is greater than area C.

6. The pipe-gripper of claim 1 further comprising:

a drive shaft, the draft shaft connected to the rotor drive, the drive shaft having a toothed wheel, the drive shaft engaged with the transmission assembly.

7. The pipe gripper of claim 6, wherein the transmission assembly comprises:

a first gear wheel and a second gear wheel; and a first driving wheel and a second driving wheel, the first driving wheel engaged with the first gear wheel and the second driving wheel engaged with the second gear wheel, the first and second driving wheels in engagement with the toothed rim at the toothed rim engagement points.

8. The pipe gripper of claim 1 further comprising a die actuator, the die actuator comprising a second drive motor.

a second drive gear;

a clamp transmission, the clamp transmission engaged with the second drive gear; and a threaded rod, the threaded rod mechanically connect to the clamp transmission, the threaded rod in engagement with the at least one clamp; and a decoupler motor, the decoupler motor engaged with a rotate drive coupling and adapted to raise or lower the second drive gear in and out of engagement with the clamp transmission.

9. The pipe gripper of claim 1 further comprising a grabber, the grabber affixed to the elongated housing.

10. A pipe gripper comprising:

an elongated housing;

a rotor, the rotor positioned within the elongated housing, the rotor having a periphery, the rotor having a longitudinal groove extending axially therethrough;

a clamp, the clamp positioned within the rotor;

a rotor drive, the rotor drive positioned within the elongated housing; wherein the rotor is adapted to generate make-up or break out torque on a pipe positioned within the rotor.

11. The pipe-gripper of claim 10, wherein the rotor is adapted to generate a torque of between 2,000 and 60,000 ft-lbs on a pipe positioned within the rotor.

12. The pipe-gripper of claim 11, wherein the torque may be applied clockwise or counter clockwise.

13. A method of providing make-up torque to a pipe comprising:

providing a pipe-gripper, the pipe gripper comprising:

an elongated housing, a rotor, the rotor positioned within the elongated housing, the rotor having a periphery, the rotor having a longitudinal groove extending axially therethrough, a rotor drive, the rotor drive positioned within the elongated housing, and a clamp, the clamp positioned within the rotor;

clamping a pipe within the longitudinal groove of the rotor using the clamp;

rotating the pipe using the rotary drive to achieve make-up torque.

14. The method of claim 13, wherein the step of clamping the pipe and rotating the pipe do not occur simultaneously.

15. The method of claim 14, wherein the longitudinal groove has a groove mouth having width of distance A, wherein the distance between the engagement points is distance B, and wherein distance B is larger than distance A.

16. A method comprising:

supplying a pipe manipulator, the pipe manipulator having a manipulator arm mechanically connecting a pipe gripper to the manipulator arm at a manipulator arm joint, the manipulator arm joint adapted to move a pipe about a rotation axis, the pipe gripper comprising an elongated housing, a rotor, the rotor positioned within the elongated housing, the rotor having a periphery, the rotor having a longitudinal groove ex-tending axially therethrough, a rotor drive, the rotor drive positioned within the elongated housing, a clamp, the clamp positioned within the rotor;

gripping the pipe; and orienting the pipe to a pipe string.

17. The method of claim 16 further comprising after orienting the pipe to the pipe string:

screwing the pipe to the pipe string; and making up the pipe to the pipe string using make up torque.

18. The method of claim 16 further comprising:

screwing the pipe to the pipe string; and holding the pipe with the pipe gripper while supplying make up torque.

* * * * *